US008415883B2

(12) United States Patent
Allen et al.

(10) Patent No.: US 8,415,883 B2
(45) Date of Patent: Apr. 9, 2013

(54) MINIATURE CERAMIC METAL HALIDE LAMP HAVING A THIN LEG

(75) Inventors: Gary R. Allen, Chesterland, OH (US); Lei Deng, Solon, OH (US)

(73) Assignee: General Electric Company, Schenectady, NY (US)

( * ) Notice: Subject to any disclaimer, the term of this patent is extended or adjusted under 35 U.S.C. 154(b) by 392 days.

(21) Appl. No.: 11/964,416

(22) Filed: Dec. 26, 2007

(65) Prior Publication Data

US 2009/0167179 A1 Jul. 2, 2009

(51) Int. Cl.
*H01J 17/18* (2006.01)
*H01J 61/36* (2006.01)

(52) U.S. Cl.
USPC ..... 313/623; 313/634

(58) Field of Classification Search ..... 313/623, 313/628, 636, 634, 631
See application file for complete search history.

(56) References Cited

U.S. PATENT DOCUMENTS

| | | | | |
|---|---|---|---|---|
| 5,866,982 | A * | 2/1999 | Scott et al. | 313/634 |
| 6,075,314 | A * | 6/2000 | Huettinger et al. | 313/332 |
| 6,215,254 | B1 | 4/2001 | Honda et al. | |
| 6,249,086 | B1 | 6/2001 | Honda et al. | |
| 6,621,219 | B2 | 9/2003 | Allen et al. | |
| 6,882,109 | B2 * | 4/2005 | Nakano et al. | 313/625 |
| 7,600,894 | B1 * | 10/2009 | Simon | 362/244 |
| 2001/0003411 | A1 * | 6/2001 | Honda et al. | 313/607 |
| 2002/0084754 | A1 * | 7/2002 | Allen et al. | 313/623 |
| 2003/0189406 | A1 | 10/2003 | Huttinger et al. | |
| 2004/0012957 | A1 * | 1/2004 | Bachl et al. | 362/241 |
| 2004/0256994 | A1 * | 12/2004 | Venkataramani et al. | 313/634 |
| 2005/0082984 | A1 * | 4/2005 | Wada et al. | 313/623 |
| 2005/0134179 | A1 * | 6/2005 | Takagaki et al. | 313/631 |
| 2006/0232212 | A1 * | 10/2006 | Scott et al. | 313/636 |
| 2006/0290285 | A1 | 12/2006 | Lapatovich et al. | |
| 2007/0085478 | A1 * | 4/2007 | Dakin et al. | 313/571 |
| 2008/0116806 | A1 * | 5/2008 | Van Eysendeyk et al. | 313/623 |
| 2008/0157675 | A1 * | 7/2008 | Gunther et al. | 313/624 |

FOREIGN PATENT DOCUMENTS

| | | | |
|---|---|---|---|
| EP | 1 107 285 | A2 | 6/2001 |
| WO | WO 2006077516 | A2 * | 7/2006 |

OTHER PUBLICATIONS

PCT/US2008/083474, International Search Report, mailed Mar. 4, 2009.

* cited by examiner

*Primary Examiner* — Mariceli Santiago
*Assistant Examiner* — Glenn Zimmerman
(74) *Attorney, Agent, or Firm* — Fay Sharpe LLP

(57) ABSTRACT

A low watt ceramic metal halide lamp has a body with a discharge chamber disposed therein. First and second hollow legs extend from the discharge chamber and received first and second electrode assemblies, respectively, therethrough with first ends of the electrode assemblies disposed in spaced relation in the discharge chamber. Use of thin legs limits heat flux from the discharge chamber. Preferably, thin legs are defined by a load dissipation factor of the ceramic part being less than 0.065 $mm^2$/watt. In addition, thermal conductance along the leg is controlled via a load dissipation factor of the molybdenum mandrel portion of the electrode assembly being maintained less than 0.0008 $mm^2$/watt.

17 Claims, 7 Drawing Sheets

| | THIS INVENTION CMH39W/830 | | PRIOR ART-CMH39W/830 | |
|---|---|---|---|---|
| DESIGN CONCEPT | AVE | SD | AVE | SD |
| VOLTS | 97.4 | 2.4 | 92.2 | 2.1 |
| WATTS | 39 | 0 | 39 | 0 |
| LUMENS | 3421 | 103 | 3415 | 72 |
| ccx | 0.4401 | 0.0045 | 0.4253 | 0.0025 |
| ccy | 0.3966 | 0.0024 | 0.3972 | 0.0022 |
| CRI | 88.7 | 1.3 | 83.4 | 0.7 |
| CCT | 2886 | 69 | 3150 | 36 |
| dccy | −0.0085 | 0.0024 | −0.0025 | 0.0017 |
| R9 | 10.2 | 9.2 | −21.0 | 3.4 |
| HALIDE WEIGHT | 5.5 mg | | 6.5 mg | |
| A/P FOR PCA | 0.0577 | | 0.096 | |
| A/P FOR MOLY | 0.00047 | | 0.0033 | |

| PRIOR ART-CDM PGJ5 39W | | THIS INVENTION CMH39W/942 | | PRIOR ART-CDM39W/942 | |
|---|---|---|---|---|---|
| AVE | SD | AVE | SD | AVE | SD |
| 99.3 | 1.5 | 94.4 | 1.2 | 85.6 | 1.4 |
| 38.9 | 0.1 | 39 | 0 | 39 | 0 |
| 2953 | 21 | 3508 | 118 | 2976 | 176 |
| 0.433 | 0.0037 | 0.3779 | 0.0049 | 0.3721 | 0.0029 |
| 0.3932 | 0.0022 | 0.3659 | 0.0038 | 0.3657 | 0.0018 |
| 90.7 | 0.6 | 90.7 | 0.9 | 85.5 | 1.3 |
| 2977 | 47 | 3990 | 115 | 4159 | 91 |
| −0.009 | 0.001 | −0.009 | 0.002 | −0.0057 | 0.0029 |
| 44.1 | 2.8 | NA | | NA | |
| 6.0 mg | | 3.3 mg | | 6.0 mg | |
| 0.073 | | 0.0577 | | 0.08 | |
| 0.0015 | | 0.00047 | | 0.0012 | |

*Fig. 6*

MINIATURE CERAMIC METAL HALIDE LAMP HAVING A THIN LEG

BACKGROUND

This application relates to lamps, and particularly a ceramic metal halide (CMH) lamp, and improving the performance of CMH lamps by reducing heat loss associated with the lamp assembly. More particularly, the disclosure is related to controlling heat loss from the arc chamber to the legs with resultant increased efficiency of light radiation.

CMH lamps have become increasingly popular due to significant customer benefits. Traditionally, quartz arc tubes have been commonly used in metal halide arc discharge lamps. More recently, however, there has been a trend toward using CMH lamps that include a ceramic arc tube because of better color uniformity and stability, as well as increased lumens per watt (LPW) and color rendering (Ra) relative to traditional arc discharge lamps. These performance advantages of ceramic arc tubes are enabled by their higher temperature compared with quartz arc tubes and by a reduced rate of sodium loss.

In discharge lamps of this type, efficacy and lamp performance are adversely affected by the loss of energy through thermal conduction along the legs, or ends, of the arc tube. Commonly assigned U.S. Pat. No. 6,621,219 shows and describes one manner of limiting axial heat flux along the arc tube leg by designing the leg structure to have a reduced thermal conductivity, and the details of that disclosure are fully incorporated herein by reference. Particularly, reducing the molybdenum mandrel diameter effectively reduces the thermal conductivity of this component even when the diameter of the overwind wire is increased or when multiple overwinds are used. That is, the overwind provides a distinct reduction in thermal conduction along its length because of the helical conformation when compared to the mandrel portion.

There are three primary areas of thermal conductance in a direction generally parallel to the leg axis. A major thermal conductance is in the leg itself, or the polycrystalline alumina (PCA). The next largest thermal conductance is along the molybdenum mandrel. The third area of thermal conductance, and also the smallest, relates to the molybdenum overwind.

Miniaturization, improved color quality (Ra over 90) and energy efficiency are three major industry trends in the area of CMH technology development. As CMH lamps are made even smaller, it becomes more difficult to achieve a target seal glass temperature, a shorter overall arc tube length that fits inside an outer jacket, and simultaneously achieve targeted photometric performance, i.e., lumens, Ra, etc. Other parties have reduced the length of the leg or the length of the arc chamber, but provide a thicker leg. Consequently, performance of the resultant lamp is not as desired.

A need therefore exists to provide a CMH lamp that avoids an increase in seal glass temperature, has reduced thermal conductivity along the leg and thereby results in more energy distribution into the arc for light, and enables shorter leg length that eases fitting of the arc tube into an outer jacket and provides greater flexibility in arc tube body design to optimize performance.

BRIEF DESCRIPTION

This disclosure relates to a ceramic metal halide lamp that includes a body having a discharge chamber and first and second hollow legs extending from the discharge chamber.

First and second electrode assemblies extend through the legs, respectively and the legs are preferably thin to limit heat flux from the discharge chamber therealong.

The thin legs have a load dissipation factor defined by a cross-sectional area (A) of the leg relative to the power (P) of the lamp ($A/P<0.065$) or less than 0.065 $mm^2$/watt. Here, the cross-sectional area of the leg is given by $A=\pi*(OD^2-ID^2)/4$, where the OD and ID are the outside and inside diameters of the ceramic leg, if the leg components are cylindrical in shape, or an equivalent area if the components are not substantially cylindrical.

Preferably, the ceramic metal halide lamp is a low watt lamp, more preferably on the order of about 70 watts or less.

The electrode assembly further includes a molybdenum mandrel having a load dissipation factor defined by a cross-sectional area (A) of the mandrel relative to the power (P) of the lamp ($A/P<0.0008$) less than 0.0008 $mm^2$/watt to reduce the heat flux in the leg.

One or both of these load dissipation factors may be incorporated into a lamp to reduce the heat flux through the CMH lamp leg.

A method of improving performance for a ceramic metal halide lamp includes reducing the heat flux by limiting the leg cross-sectional area-to-power ratio to less than 0.065 $mm^2$/watt and/or limiting a molybdenum mandrel load dissipation factor to less than 0.0008 $mm^2$/watt.

The present disclosure can either advantageously lower the seal glass temperature and thereby improve the reliability of the lamp or provide for a shorter leg while avoiding an increase in seal glass temperature to maintain good reliability.

It is also found that a thin leg enables the use of a smaller seal glass ring and therefore a shorter seal glass wicking length. As a result, the total arc tube length is reduced significantly and eases the fitting of the arc tube inside an outer jacket.

The lamp also achieves superior photometric performance in terms of lumens and Ra by reducing thermal losses in the leg.

Still other benefits and advantages of the disclosure will become apparent from reading and understanding the following detailed description.

BRIEF DESCRIPTION OF THE DRAWINGS

FIG. 6 is a table comparing one hundred hour test data of the present disclosure relative to two prior art designs where the prior art designs illustrate the typical tradeoff between lumens and Ra.

DETAILED DESCRIPTION

Figure 1:
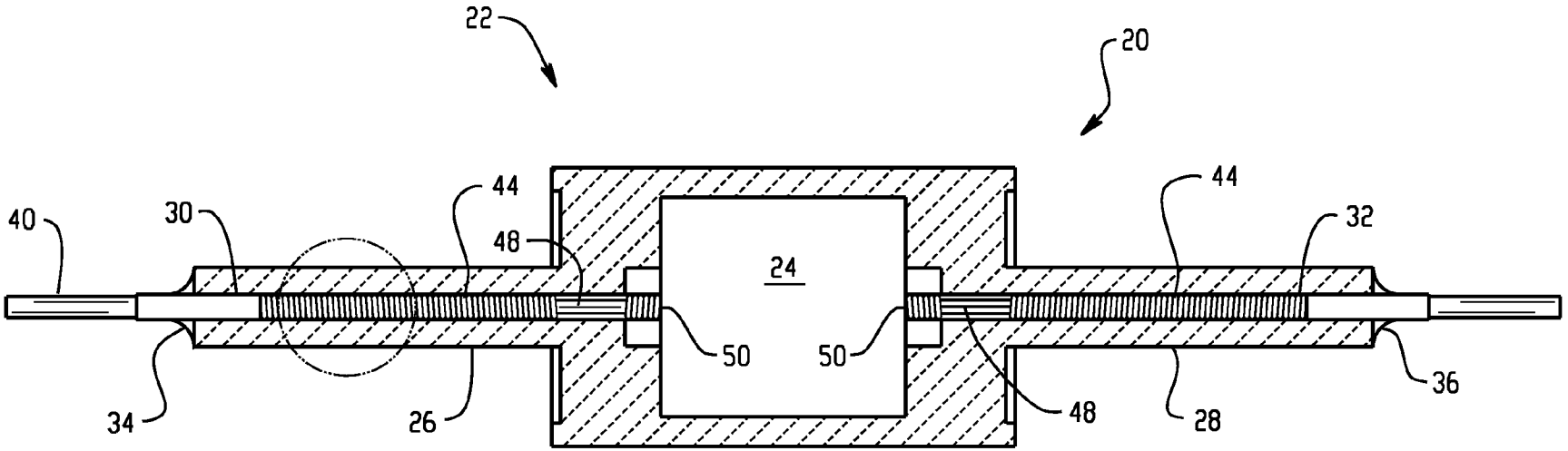
FIG. 1 is an elevational view of the lamp assembly shown partially in cross-section according to a preferred embodiment.

FIG. 1 shows a lamp assembly 20 having a hollow arc tube body or envelope 22 that includes an interior cavity or arc discharge chamber 24. Extending in longitudinally opposite axial directions are first and second hollow legs 26, 28. As is known in a ceramic arc tube of this type, openings in the legs receive electrode/lead wire assemblies 30, 32, respectively, that are connected to an external power source (not shown). In addition, seals 34, 36 are provided at each outer end of the legs to hermetically seal the electrode assemblies relative to the legs. For example, a preferred seal is a frit seal that is typically provided along a niobium portion of the lead wire assembly. More particularly, the lead wire/electrode assemblies 30, 32 are preferably three-part assemblies including a first or niobium outer lead 40, a second or intermediate component such as a molybdenum mandrel 42 (FIG. 3) with a molybdenum overwind 44. Of course, other materials may be used such as a cermet (ceramic metal) that have many of the same desirable properties of molybdenum and have been found to operate well in the high temperature environment of metal halide lamps. A third or inner lead 46 is comprised of shank 48 and coil 50, both typically made of tungsten. Thus, the outer niobium is joined to the intermediate component comprised of the molybdenum mandrel and molybdenum overwind which, in turn, is joined to the inner lead or electrode comprised of the shank and coil.

Figure 2:
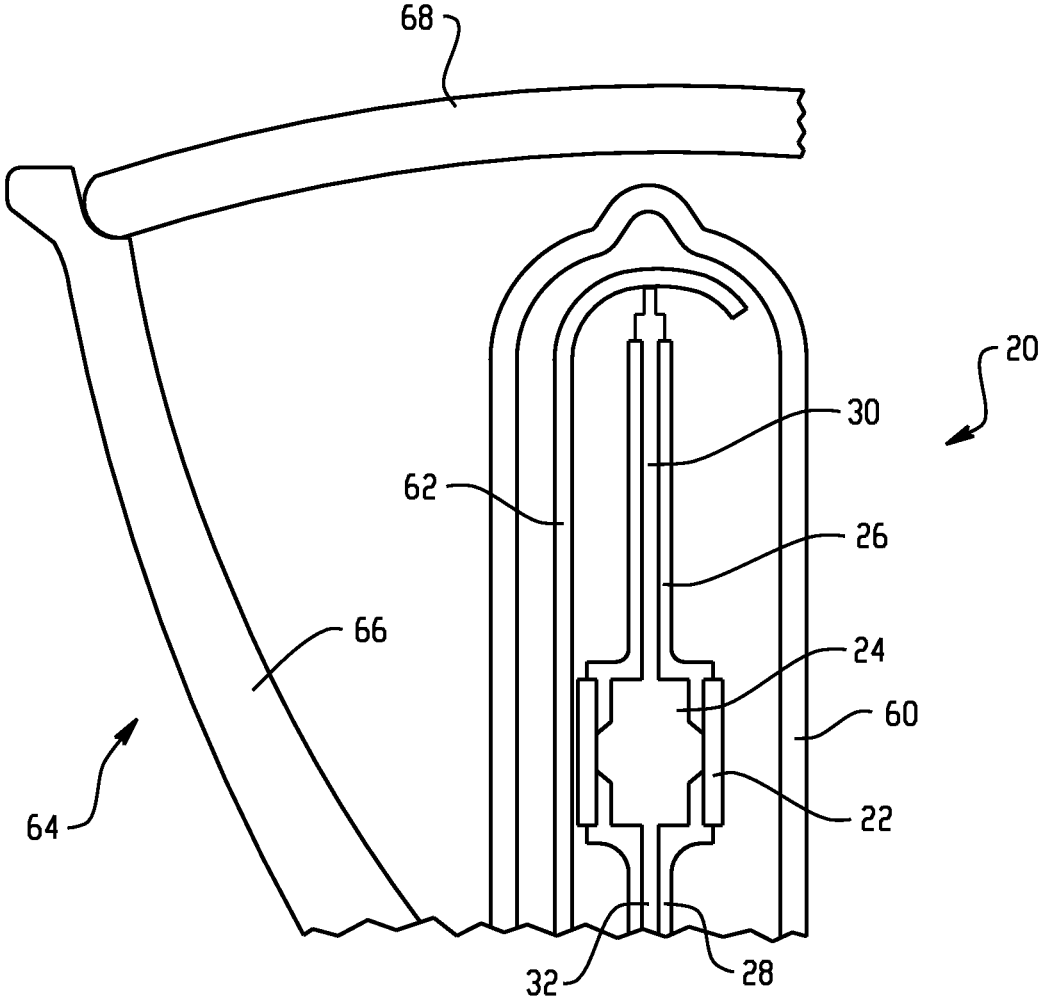
FIG. 2 is an enlarged view of the lamp assembly of FIG. 1 as supported within an outer jacket and mounted in a reflector assembly.

As shown in FIG. 2, the lamp 20 may be received in an outer jacket or capsule 60, particularly when the lamp is reduced in size such as in the low watt examples of the present disclosure. Support 62 serves to mechanically and electrically support the electrode assembly associated with one of the legs within the capsule, while the other leg and electrode assembly (not shown) are joined to the base of the capsule. In addition, the capsule is mounted within the reflector assembly 64 comprised of reflector 66 and lens 68. The capsule may be oriented as desired within the reflector assembly, for example, the capsule and light source are disposed along an axis of revolution of the reflector in the preferred arrangement. However, other orientations may be used such as offset and parallel to the reflector axis or perpendicular to the reflector axis without departing from the scope and intent of the present disclosure.

Figure 3:
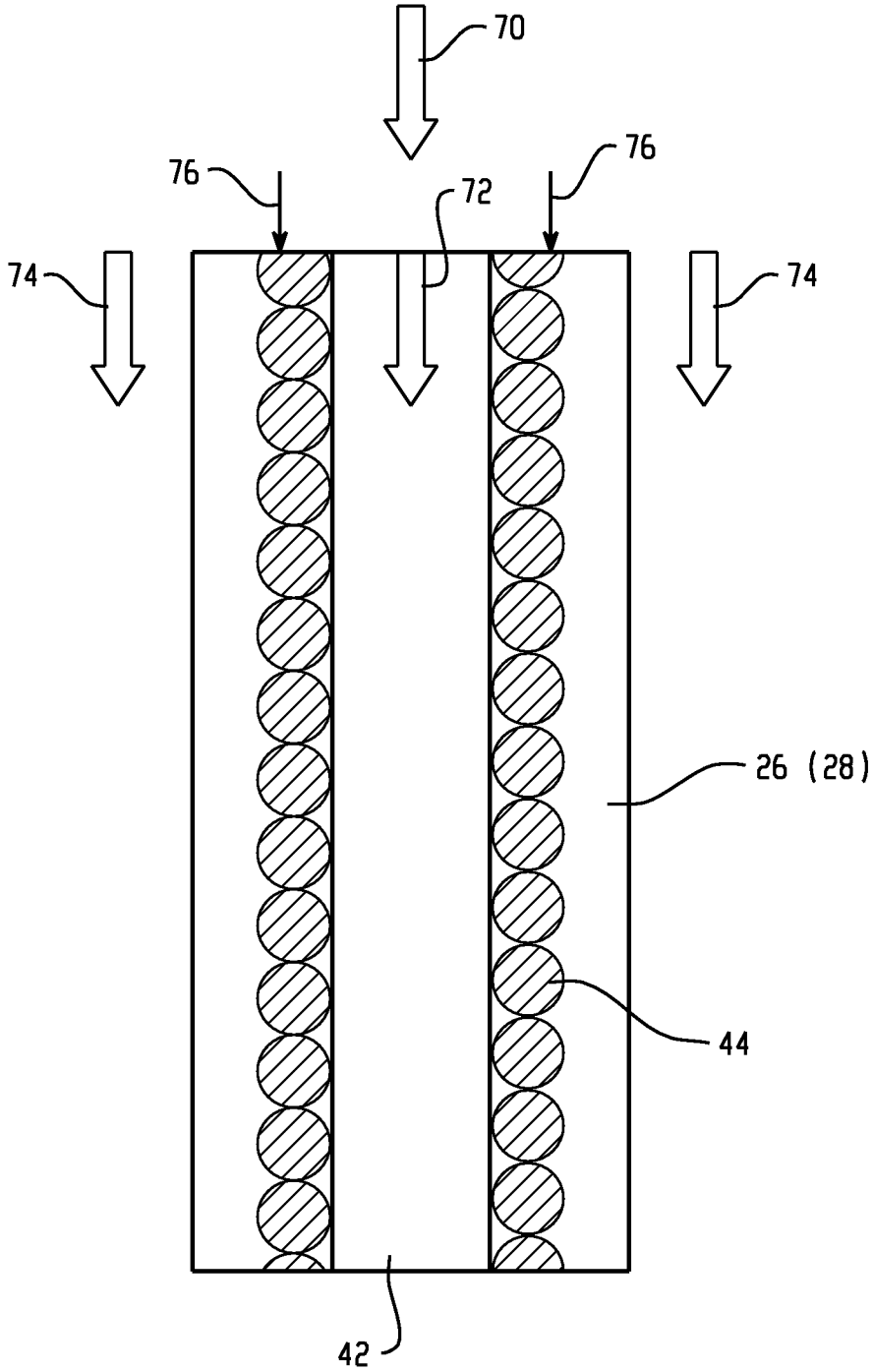
FIG. 3 is an enlarged view of a leg, particularly the encircled portion of FIG. 1.

As schematically illustrated in FIG. 3, there are three channels along which thermal flux is conducted axially from the arc chamber through the legs, parallel to the axis of the legs. There is also a radial component of heat flux radially outward from the mandrel, through the overwind, through the annular gap between the overwind and the inside of the PCA leg, and then radially through the PCA leg to the outside ambient. This radial component of the heat flux serves to keep the axial temperature profile approximately equal in each of the three axial channels, although the magnitude of the radial heat flux is smaller than the axial components, and is not significantly affected by the radial dimensions of any of the three channels. First, a major axial thermal conductance is associated with the molybdenum mandrel. Thus, reference arrow 70 is indicative of all the thermal gradients that extend in a direction parallel to the legs, while reference arrow 72 is particularly representative of the thermal conductance through the molybdenum mandrel. Another thermal conductance is represented by arrows 74 and is associated with the polycrystalline alumina (PCA) leg. The third thermal conductance, as represented by arrows 76, is associated with the molybdenum overwind. As noted previously, there is a distinct reduction in the thermal conduction along the length of the legs through the overwind because of the helical conformation and elongated path of the helix.

There is a desire to reduce the heat flux from the arc discharge chamber and down the legs in order to protect the seals 34, 36 disposed at the far end of each leg. The seals cannot run too hot or the life of the lamp may be adversely impacted. Moreover, heat transfer down the leg correlates to a corresponding loss of heat from the arc tube. It is desirable to reduce the heat loss from the arc tube in order to keep the intrinsic efficiency of the arc tube high and thus obtain higher lumens per watt and better photometric performance, including high color quality.

One proposed solution is outlined in the commonly-owned U.S. Pat. No. 6,621,219, where the dimension of the molybdenum mandrel was reduced relative to the dimension of the overwind without regard to the lamp wattage. As taught in the present disclosure, it has been determined that a thin leg relative to the lamp wattage is an important feature to limit the heat flux. The thin leg is described by the ratio of the cross-sectional area of the leg ($\pi*(OD^2-ID^2)/4$) compared to the lamp power, and thus is expressed as area/power (A/P) or $mm^2/W$. In higher wattage lamps, this thin leg dissipation factor on the order of less than 0.065 $mm^2/W$ may be met because the body is so big and the watts are sufficiently high to keep this ratio low. However, this is much more difficult to achieve in the low wattage lamps. Generally, by low watt is meant approximately 70 watts or less. Other than lamps made by the assignee of the present disclosure, most other lamp manufacturers use "thick" legs when generally shrinking or reducing the overall size of the lamp for low watt applications.

It has been found that the low dissipation factor of the leg has a greater impact with respect to lower wattage lamps. Reducing the transverse lateral dimension of the PCA leg becomes an important consideration in this ratio. As a result, the seal at the far end of the leg is protected and improved photometrics, i.e., higher lumens per watt or better color, i.e., improved Ra, are achieved, because the arc tube can operate more efficiently.

Again, this is particularly important in the lower wattage lamps. The lower wattage lamps are generally smaller and thus the axial lengths of the legs are reduced. Normally, the reduced axial length of the legs would contribute to a higher seal temperature and may adversely impact the lamp life. However, by implementing the thin leg dissipation factor, not only is the leg axially shortened, but the low watt lamp can still achieve an acceptable seal temperature. Moreover, reducing the overall size of the lamp and making it more compact allows the small wattage lamp to be placed within outer jackets or capsules, or placed into smaller reflectors. Therefore, it has been determined that maintaining the PCA leg dissipation factor ratio at less than 0.065 $mm^2/W$ allows the lamp to be made smaller, the axial length of the legs shortened, and yet the seals can be moved closer to the arc without being adversely impacted by an increase in heat.

In addition, it has been determined that the electrode molybdenum mandrel load dissipation factor can also be expressed as a cross-sectional area relative to the power. Particularly, the mandrel load dissipation factor or ratio should be less than 0.0008 $mm^2/W$. The smaller diameter molybdenum mandrel is important because the thermal conductance is typically an order of magnitude greater than the thermal conductance of the PCA leg.

So, in order to manage the total thermal flux in the leg, the molybdenum mandrel cross-sectional area relative to the wattage is one factor and, in addition, the PCA leg dissipation factor is another. It has also been advantageously found that a non-linear benefit also results when the dissipation factors of both the molybdenum cross-sectional area relative to the wattage and the PCA leg cross-sectional area relative to the wattage are controlled. These thermal conductances are like electrical resistors in parallel where the net resistance is the same as adding the resistances inversely. The same is true here with the thermal conductances which are inverse of the thermal resistances, i.e., the net thermal conductance is the sum of adding the individual thermal conductances. Consequently, addressing the heat flux by controlling the cross-sectional area of the leg relative to the power reduces the seal glass temperatures and achieves the desired lamp performance. Alternatively, controlling the cross-sectional dimension of the molybdenum mandrel relative to the power also achieves these same objectives. Moreover, when these two thermal conductance features are controlled in combination, the additive effect has an even greater impact.

Figure 4:
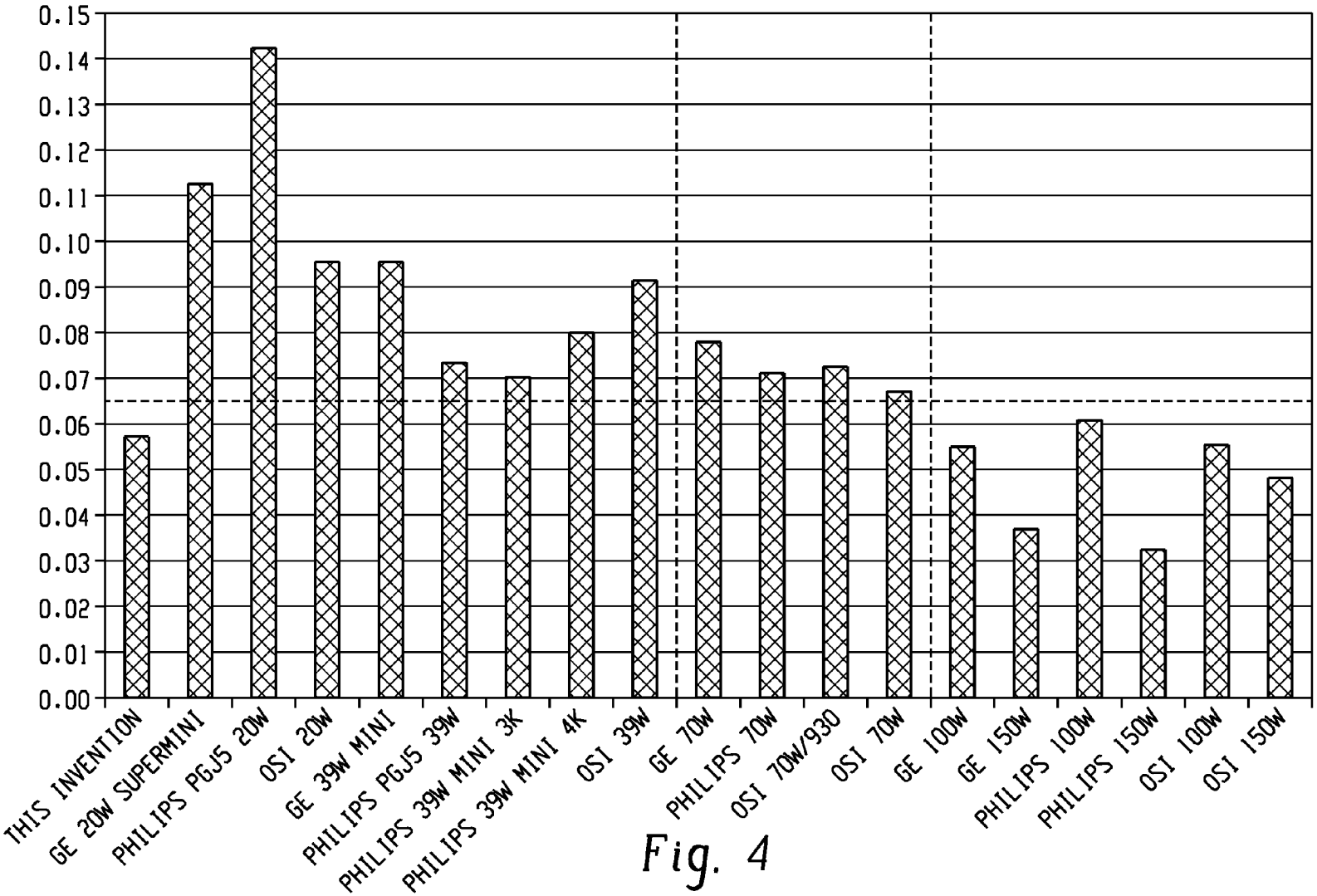
FIG. 4 is a bar graph of PCA data.
Figure 5:
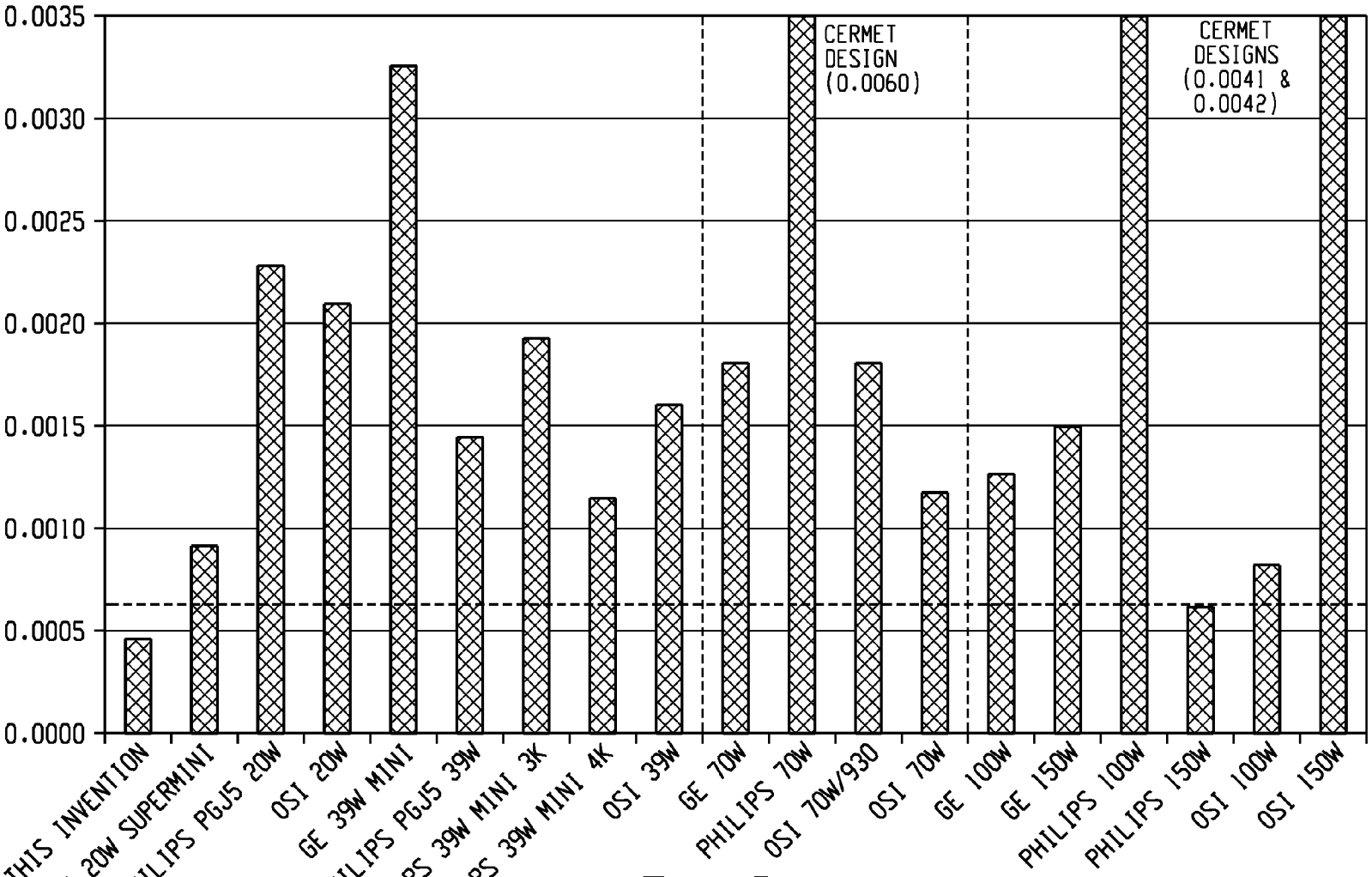
FIG. 5 is a bar graph of the molybdenum mandrel data.

FIGS. 4 and 5 graphically illustrate the advantages associated with the leg ceramic load dissipation factor and the molybdenum mandrel dissipation factor. It is evident that maintaining the PCA leg thermal conductance is preferably less than 0.065 $mm^2/W$, and more preferably less than 0.06 $mm^2/W$ exhibits a significant improvement and likewise, the molybdenum mandrel load dissipation factor is preferably up to 0.0008 $mm^2/W$, and more preferably less than 0.0006 $mm^2/W$.

FIG. 4 represents the PCA leg thermal conductance values of various lamps. A horizontal line is drawn in the graph at the previously noted thermal conductance value of 0.065 $mm^2/W$ that represents a clear demarcation in low wattage lamps of the thin leg design of the present disclosure relative to other low watt lamps, and how the same value also compares to the higher wattage lamps (100 W and greater). FIG. 5 similarly graphically illustrates the molybdenum mandrel thermal conductance values of various lamps. A horizontal line represents a demarcation in the thermal conductance values of the molybdenum mandrel between the present disclosure and prior art lamps at a value of approximately 0.0008 $mm^2/W$.

Figure 7:
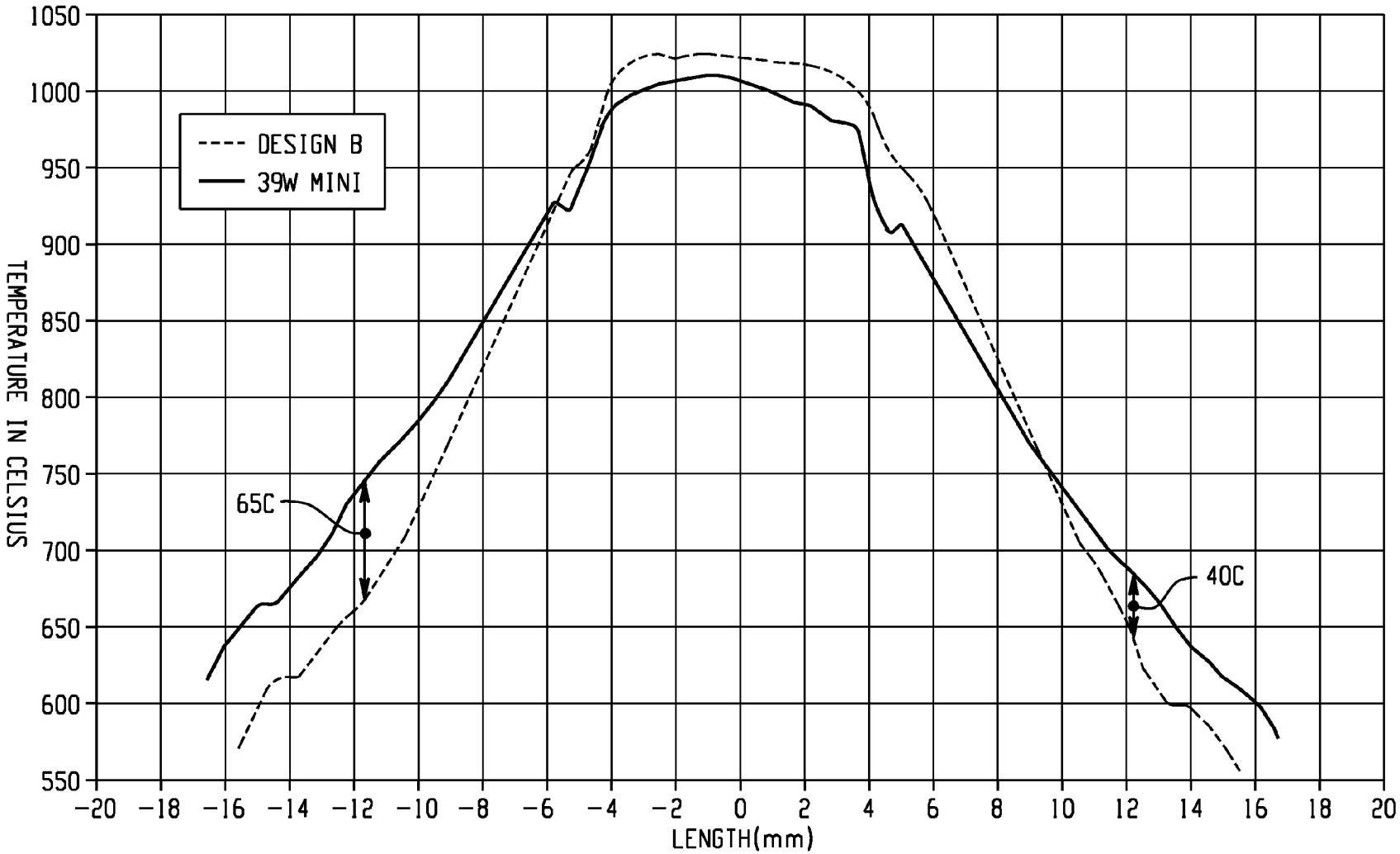
FIG. 7 is a graph of the advantages associated with the present disclosure.

As evidenced in FIG. 6, there is an improvement in five points on the CRI, and the CRI to R9 improvements without sacrificing lumens (3,421 lumens versus 3,415 lumens), and all achieved with a 1 mg halide weight reduction. This also corresponds to less ceramic body corrosion over the life of the lamp and an associated material cost savings. Also, FIG. 7 shows the improvements in the seal temperatures of a thin leg lamp employing the features of the present disclosure.

The invention has been described with reference to various preferred embodiments. Obviously, modifications and alterations will occur to others upon reading and understanding the preceding detailed description. It is intended that the invention be construed as including all such modifications and alterations.

What is claimed is:

1. A method of improving performance for a low watt ceramic metal halide lamp comprising:

providing a ceramic arc tube body having a discharge chamber with first and second legs disposed therein in spaced relation, and at least one of the legs is hollow and extends from the discharge chamber;

reducing heat flux in the at least one hollow leg by limiting a leg cross-sectional area to power ratio (Area/watt) to less than 0.065 $mm^2$/watt such that a power rating of the lamp is less than 40 watts; and limiting a molybdenum mandrel load dissipation factor to less than 0.0008 $mm^2$/watt.

2. A low watt ceramic metal halide lamp comprising:

a ceramic body having a discharge chamber disposed therein;

first and second hollow legs extending from the discharge chamber;

first and second electrode assemblies including molybdenum mandrels extending through the first and second legs, respectively, and first ends of the electrode assemblies disposed in spaced relation in the discharge chamber;

wherein the legs have a thin profile that limits heat flux from the discharge chamber therealong, the thin profile having a load dissipation factor less than 0.065 $mm^2$/watt such that a power rating of the lamp is less than 40 watts; and wherein each mandrel has a load dissipation factor less than 0.0008 $mm^2$/watt.

3. The low watt ceramic metal halide lamp of claim 2 wherein the legs are formed of a polycrystalline alumina.

4. The low watt ceramic metal halide lamp of claim 2 wherein the first and second legs extend in substantially opposite linear directions from the discharge chamber.

5. The low watt ceramic metal halide lamp of claim 2 wherein the electrode assemblies are sealed to the respective first and second legs at leg ends spaced from the discharge chamber.

6. The low watt ceramic metal halide lamp of claim 2 further comprising a reflector for directing light from the discharge chamber.

7. The low watt ceramic metal halide lamp of claim 2 further comprising an outer jacket received about the discharge chamber.

8. The ceramic metal halide lamp of claim 2 wherein the mandrel load dissipation factor and the load dissipation factor of the leg cross-section each limit the amount of thermal conductance to seals formed between an electrode assembly and a respective leg at a location spaced from the discharge chamber.

9. A ceramic metal halide lamp comprising:

a ceramic body having an arc discharge chamber containing a fill material therein;

first and second hollow legs extending outwardly from the arc discharge chamber;

first and second electrode assemblies extending through the first and second hollow legs, respectively, each electrode assembly including one of a ceramic metal and a molybdenum mandrel intermediate component received in the hollow leg and interconnecting an outer lead with an inner lead;

wherein dissipation of heat flux along a leg is controlled by maintaining a leg dissipation ratio of a cross-sectional area of each leg relative to lamp power as measured in $mm^2$/watt to less than 0.065 $mm^2$/w and a mandrel load dissipation ratio of the cross-sectional area of a mandrel of the electrode assemblies relative to the lamp power as measured in $mm^2$/w to less than 0.0008 $mm^2$/w wherein the lamp has a power rating of less than 40 watts.

10. The ceramic metal halide lamp of claim 9 wherein the legs are formed of a polycrystalline alumina.

11. The ceramic metal halide lamp of claim 2 wherein the load dissipation factor of the cross-sectional area of each leg is less than 0.06 $mm^2$/watt.

12. The ceramic metal halide lamp of claim 2 wherein the molybdenum mandrel load dissipation factor is less than 0.0006 $mm^2$/watt.

13. The ceramic metal halide lamp of claim 9 wherein the load dissipation factor of the cross-sectional area of each leg is less than 0.06 $mm^2$/watt.

14. The ceramic metal halide lamp of claim 13 wherein the molybdenum mandrel load dissipation factor is less than 0.0006 $mm^2$/watt.

15. The ceramic metal halide lamp of claim 9 wherein the inner lead includes a tungsten shank and tungsten coil.

16. The ceramic metal halide lamp of claim 9 wherein the outer lead is niobium.

17. The ceramic metal halide lamp of claim 9 wherein the intermediate component includes an overwind.

* * * * *